US009034433B1

(12) United States Patent
Plummer et al.

(10) Patent No.: US 9,034,433 B1
(45) **Date of Patent: *May 19, 2015**

(54) AUTOMATED METHOD FOR MAKING A SHUTTER WITH A WOOD GRAINED APPEARANCE

(71) Applicant: GLASSCRAFT DOOR COMPANY, Houston, TX (US)

(72) Inventors: John B. Plummer, Houston, TX (US); Matthew James O'Shea, Houston, TX (US); Joseph Gene Denley, Cypress, TX (US)

(73) Assignee: GLASSCRAFT DOOR COMPANY, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/260,083

(22) Filed: Apr. 23, 2014

Related U.S. Application Data

(63) Continuation-in-part of application No. 13/967,265, filed on Aug. 14, 2013, now Pat. No. 8,722,151, which is a continuation-in-part of application No. 13/097,632, filed on Apr. 29, 2011, now abandoned.

(51) Int. Cl.

| | |
|---|---|
| ***B05D 1/02*** | (2006.01) |
| ***B05D 3/04*** | (2006.01) |
| ***E06B 9/02*** | (2006.01) |
| ***B05D 3/06*** | (2006.01) |
| ***B05D 7/00*** | (2006.01) |

(52) U.S. Cl.

CPC ... *B05D 1/02* (2013.01); *E06B 9/02* (2013.01); *B05D 3/0413* (2013.01); *B05D 3/065* (2013.01); *B05D 7/56* (2013.01); *B05D 7/586* (2013.01); *B05D 2201/02* (2013.01); *B05D 2503/00* (2013.01)

(58) Field of Classification Search

None

See application file for complete search history.

(56) References Cited

U.S. PATENT DOCUMENTS

| | | | | | |
|---|---|---|---|---|---|
| 4,023,320 | A | * | 5/1977 | Jackson | 52/473 |
| 5,357,439 | A | * | 10/1994 | Matsuzaki et al. | 700/96 |
| 5,379,551 | A | * | 1/1995 | Swapp | 49/82.1 |
| 5,413,814 | A | | 5/1995 | Bowen et al. | |
| 5,463,555 | A | * | 10/1995 | Ward et al. | 700/96 |
| 5,534,352 | A | | 7/1996 | Pittman et al. | |
| 5,778,958 | A | * | 7/1998 | Stebner | 160/210 |
| 5,924,255 | A | * | 7/1999 | Vagedes | 52/473 |
| 6,886,294 | B1 | * | 5/2005 | Carey | 49/73.1 |
| 7,097,879 | B2 | | 8/2006 | Bolton et al. | |
| 7,222,456 | B1 | * | 5/2007 | Carey | 49/73.1 |
| 7,333,876 | B2 | * | 2/2008 | Knight et al. | 700/123 |
| 7,335,399 | B2 | | 2/2008 | Bolton et al. | |
| 8,538,569 | B1 | * | 9/2013 | Plummer | 700/97 |

(Continued)

*Primary Examiner* — William Phillip Fletcher, III

(74) *Attorney, Agent, or Firm* — Buskop Law Group, PC; Wendy Buskop

(57) ABSTRACT

A method for creating a wood like appearance on a synthetic shutter using a sales client device, a network, computer instructions for creating a work order, a tray with scannable tray identifier to hold a shutter, a production client device connected to the network with computer instructions for applying a base coat, a glaze, and a top coat with spray treatment devices to the shutter as it automatically moves on a conveyer system. Scanning a scannable tray identifier with a plurality of sensors to link the tray identifier to the work order and to authenticate and validate the location of the tray on the conveyor system, or to initiate an alerting device. The method uses temperature control environments to control humidity and heating of the shutter while spraying, drying and UV curing.

15 Claims, 6 Drawing Sheets

(56) References Cited

U.S. PATENT DOCUMENTS

| | | | | |
|---|---|---|---|---|
| 8,689,732 | B1 | 4/2014 | Plummer et al. | |
| 8,722,151 | B1 * | 5/2014 | Plummer et al. | 427/407.1 |
| 2002/0033134 | A1 | 3/2002 | Fannon | |
| 2003/0115717 | A1 * | 6/2003 | Van Parys | 16/229 |
| 2003/0136053 | A1 * | 7/2003 | Norbert | 49/74.1 |
| 2006/0000173 | A1 | 1/2006 | Edstrom | |
| 2006/0029730 | A1 | 2/2006 | Campbell et al. | |
| 2006/0070300 | A1 * | 4/2006 | Gabriele | 49/403 |
| 2009/0019801 | A1 | 1/2009 | Coghlan et al. | |
| 2011/0138714 | A1 * | 6/2011 | Van Seters | 52/204.5 |

* cited by examiner

AUTOMATED METHOD FOR MAKING A SHUTTER WITH A WOOD GRAINED APPEARANCE

CROSS REFERENCE TO RELATED APPLICATIONS

The current application is a Continuation in Part of U.S. patent application Ser. No. 13/967,265 filed on Aug. 14, 2013, entitled "AUTOMATED METHOD FOR MAKING A COMPONENT WITH A WOOD GRAINED APPEARANCE", now issued as U.S. Pat. No. 8,722,151 on May 13, 2014, which is a Continuation in Part of U.S. patent application Ser. No. 13/097,632 filed on Apr. 29, 2011, which is now abandoned, entitled "METHOD FOR MAKING A COMPONENT WITH A WOOD GRAINED APPEARANCE". These references are hereby incorporated in their entirety.

FIELD

The present embodiments generally relate to a computer controlled automated method for making a non-wood synthetic shutter with a wood grained appearance.

BACKGROUND

A need exists for an automated method that creates polymer and non-natural synthetic shutters for windows that have a wood like look.

A need exists for a computer controlled automated method for producing synthetic shutters that are made from synthetic material to have a wood like appearance, thereby preventing the destruction of old growth forest.

A need exists for a computer controlled automated method that provide shutters that last much longer, are more resistant to weathering and exposure, and are formed from a small carbon footprint that looks like a wood shutter without being a wood shutter.

The present embodiments meet these needs.

BRIEF DESCRIPTION OF THE DRAWINGS

The detailed description will be better understood in conjunction with the accompanying drawings as follows.

Figure 1:
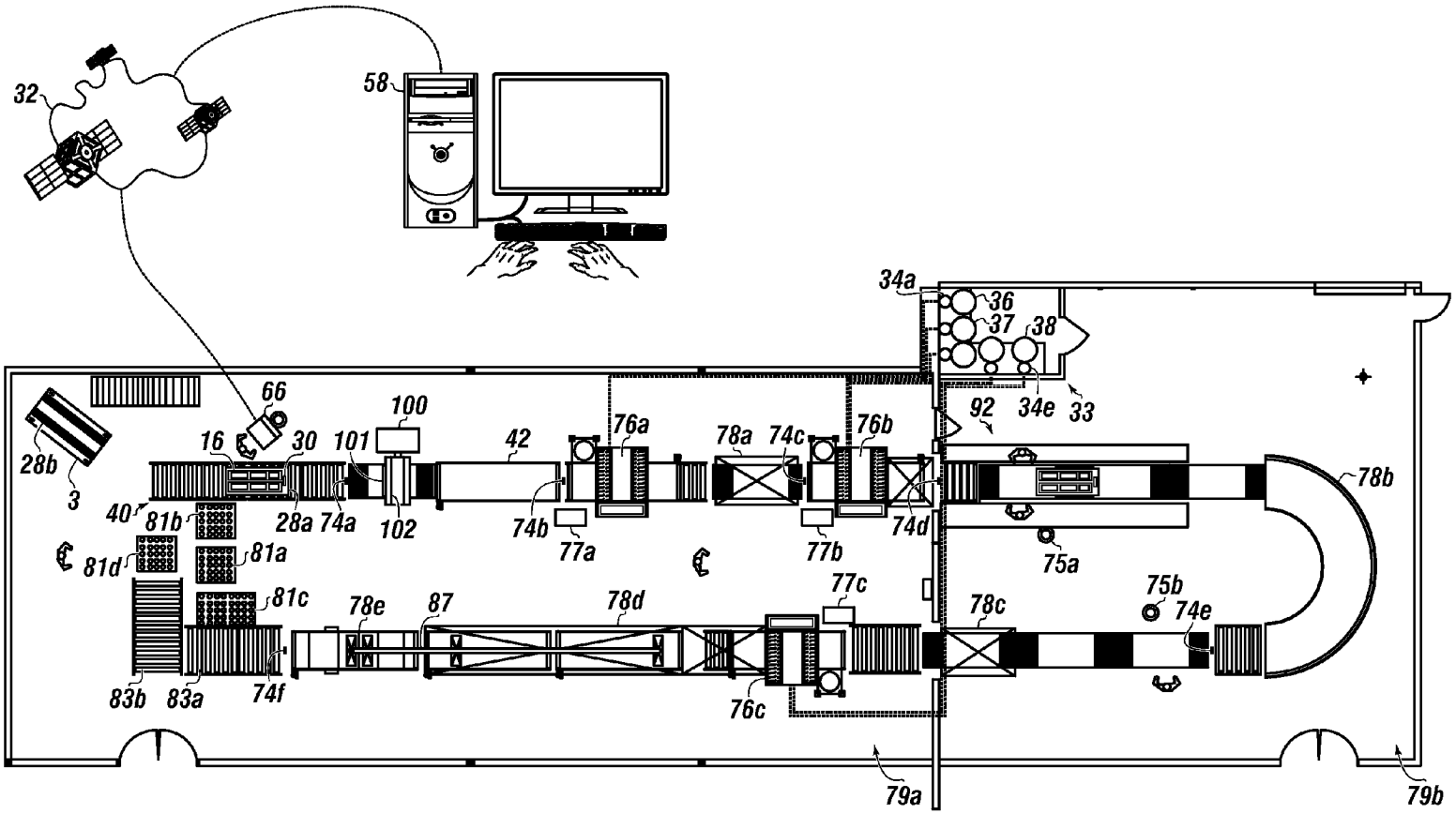
FIG. 1 depicts an overview of the system usable with the method.

The present embodiments are detailed below with reference to the listed Figures.

DETAILED DESCRIPTION OF THE EMBODIMENTS

Before explaining the present method in detail, it is to be understood that the method is not limited to the particular embodiments and that it can be practiced or carried out in various ways.

The embodiments relate to an automated method for creating a wood like appearance on a synthetic shutter made of fiberglass or plastic.

The method can use a sales client device connected to a network to actuate with computer instructions for creating a work order with a work order identifier.

The method can use a tray with a scannable tray identifier to hold a synthetic shutter for treatment.

The method can use a production client device connected to the network and computer instructions in the production client device to link the work order identifier to the tray identifier for customized creation of a synthetic shutter, such as a fiberglass shutter with a wood like appearance.

The method can use computer instructions in the production client device to instruct a processor to instruct a first spray treatment device to obtain and applying a base coat on the synthetic shutter or to skip this step if the synthetic shutter already has a base coat.

The method can include using computer instructions resident in the production client device to dry the base coat in a humidity controlled and heat controlled environment which is adapted to provide direct heat to the synthetic shutter and to cool air around the synthetic shutter to reduce humidity by at least 10 percent and up to 30 percent in a heating and cooling chamber of the first spray treatment device or in an insulated chamber connected in series along the conveying system to the first spray treatment device.

The method can include using computer instructions resident in the production client device to optionally deionize the synthetic shutter before applying the base coat to the synthetic shutter using a deionizing chamber connected to the production processor.

The method can include using computer instructions resident in the production client device to instruct a processor to instruct a second spray treatment device to obtain and apply a glaze coat to the synthetic shutter in the tray as the tray automatically moves on a conveyer system.

The tray identifier can be scanned, such as with a bar code reader, by a plurality of sensors connected to the network and the production client device to authenticate and validate the position of the tray with synthetic shutter on the conveyor system.

In an embodiment, one of the sensors can initiate an alerting device to advise another sprayer to apply a second glaze, to instruct a wiping station to remove a portion of a glaze.

The method can use climate controlled environments to simultaneously control humidity and heating of the synthetic shutter while being sprayed and dried, or UV treated if a top coat has been sprayed onto a glaze layer of the synthetic shutter. In embodiments, two of the climate controlled environments are air conditioned sealed rooms, while other climate controlled environments are flash ovens with fans, and heating and cooling tunnels.

The method, in 5 minutes to 1 hour, can treat one side of a synthetic shutter so that the second side can be treated by repeating the method in the same sequence of steps. Most current shutters will only have one side treated in this manner.

The method can produce a treated shutter very quickly with little need for humans to be exposed to spray treatment devices or high heat, or high pressure devices.

The method can be a low pressure method that is not subject to explosions or emitting volatile organic synthetic compounds.

A benefit of the invention is that workers will be subjected to lower amounts of hazardous fumes during manufacturing as the process requires fewer workers to be in the spraying area and emits only very low amounts of volatile organic compounds and zero hazardous air pollutants A benefit of the invention is that this shutter manufacturing process will be automated, enabling more shutters to be manufactured for a lower price, enabling more people to buy new shutters for their homes. Embodiments of the shutters produced and be used to improve security, add insulation, or both.

A benefit of the invention is that high energy costs that other processes incur are avoided with this process, saving fossil fuels.

A benefit of the invention is that the method produces as a final product, in an embodiment, a shutter with the wood like appearance that will additionally sustain hurricane force winds, and protect inhabitants from injuries during hurricanes when non-fiberglass, non-synthetic shutters commonly break down.

Burglaries and home invasions can be avoided using shutters made by this method on homes.

The invention provides an automated computer operated method to create a wood look on a synthetic shutter which enables each shutter to be uniquely customized. This method provides tremendous versatility in colors and top coats for individual synthetic shutters at a lower cost than handmade shutters. Additionally this process requires few air handlers, few lights, and less air conditioning than current techniques for making shutters by hand or by using semi-automated techniques.

The method inventively uses sensors that read tray identifiers secured to trays that hold the synthetic shutter as it travels down the production line. The sensors connect with a production client device that matches the sensed tray identifier with a work order for faster automated processing.

The tray identifiers can be bar codes, radio frequency identification "RFID" tags, QR codes or similar scannable identifiers.

The tray identifiers are in a data base of specifications for the type of base coat, the type and thickness of glaze and the type and thickness of a top coat. The database enables fast processing, and an automated processing such that over 100 shutters can be made by 6 people in one day, as compared with prior systems that required 50 people to manufacture 100 shutters in that same day.

A benefit of the method is that it will enable more shutters to be made in the United States and create more jobs, since a lot of shutter manufacturing is currently not in the United States, and in countries like Taiwan, Korea and Indonesia. This invention will enable jobs to return to the United States improving the balance of trade.

The term "work order" as used herein can refer to a document, which can be electronic, that contains information on color, synthetic shutter thickness, synthetic shutter overall size, requirements for holes in shutters, slat sizes, numbers of slats, requirements for certain extra molding that might be desired on the final synthetic shutter.

The term "work order" as used herein in addition to the definitions described above, in embodiments, can include information on the size of window opening adjacent to the synthetic shutter.

In an embodiment, client devices usable in the method can be laptops, computers, or a computerized controller, such as a central processing unit (CPU) for monitoring and running an automated production line.

In embodiments, a production client device can be used to operate with sensors, spray treatment devices, environment control areas and the sales client device to use information from a work order produced by a sales client device connected via a network.

In embodiments, the invention can be logged into via a network from anywhere in the world.

In embodiments, the sales client device can contain customer information, which can include financial information.

The term "customer information" as the term is used herein can refer to a company name, a contact at the company, a company address, and email or cell number at a minimum. In embodiments, customer information includes customer credit information, including credit card information for completing a purchase, banking information including wire transfer information for completing a purchase, and shipping instructions.

The term "chemical specifications database" as the term is used herein can refer to mathematical mixtures of different glazes and base coat colors to achieve a customer specification. For example, the database would contain the appropriate ratios of dark brown base coat, plus a first water based tan urethane glaze and a second water based red urethane glaze to create a mahogany wood appearance synthetic shutter, such as in a 3:1:1 ratio.

The same database can contain thickness for spraying, such as 1 mil layer of brown base coat and 2 mil layer of each of the tan and red water based urethane glazes.

The chemical specification database in embodiments contains the specific and exact volumes of glaze per color to achieve a specific customer specification.

The term "a library of temperature requirements" can refer to the preset temperature limits needed to maintain synthetic shutter surface temperatures and coating temperatures at the correct temperatures to maximize adhesion of the coatings on the synthetic shutter, which may be the skin of the synthetic shutter, during processing. Multiple actions simultaneously are being performed using precise temperatures on the process line, heating the surface of the synthetic shutter, cooling air around a synthetic shutter, and UV curing the synthetic shutter. For example, the base coat can be dried at 70 degrees Fahrenheit, the glaze coat can be dried at 90 degrees Fahrenheit, and the top coat can not only be dried at 102 degrees Fahrenheit but also UV cured simultaneously with this method using the library of temperature requirements.

In embodiments, the library of temperature requirements can include temperature ranges and exact temperatures for maintaining a surface temperature, such as a skin during treatment for both before and after each coating is applied, including temperature limitations for when a top coat, such as one made from polyurethane is applied.

The air conditioning both in the individual station and in the temperature controlled room also controls humidity enabling the coating to dry. It is important to note that in embodiments, only dry heat is applied to the shutters by using the air conditioning to remove water from the air, enabling a faster dry and a faster cure than if no air conditioning was used with the heating. Hot wet heat does not dry as fast as heat that is dried according to this process. From 10 percent to 30 percent of the water is removed from the air at each drying position, each temperature control environment of the method.

The production client device can be a cloud based processing system connected to the network with multiple data storage and multiple processors connected together to perform the computer instructions of the production client device.

Turning now to the Figures, to FIG. 1 depicts an overview of the automated system usable with the method. The system can include a production client device 66 and a sales client device 58 in bidirectional communication with a network 32. The network can be a cellular network, a local area network, a wide area network, a satellite network, the Internet, or combinations thereof. The sales client device can include a sales processor and a sales data storage which can include a work order with a work order identifier. Information from the work order and work order identifier can be communicated to the production client device via the network.

The system can include a tray 28*a* for supporting a shutter 16 to be processed. A scannable tray identifier 30 can be attached to the tray for connecting with the production client device. The shutter can be a synthetic shutter. Additional trays 28*b* can be stored for use on portable holding carts 3.

The term "tray" can refer to a tray, a frame, or a pallet, which in embodiments can be a pallet containing a processor with data storage and computer instructions for holding the shutter during the treatment process. The tray can support a shutter to be processed using the work order and the work order identifier. The tray can be made of a rigid material, such as plastic that can support the weight of the shutter.

The scannable tray identifier is used to communicate via a sensor, such as a bar code scanner, with the production client device enabling the production client device to instantly identify the location of the tray anywhere during the processing of the shutter. The scannable tray identifier attached to the tray can be matched with the work order identifier via the production client device.

A conveying system 40 can be used for supporting and moving the tray 28*a*. The conveying system can moveably transport the tray automatically using the production client device.

The term "conveying system" as used herein can refer to a system that can include a motorized belt, non-motorized rollers and 360 degree rollers. The conveying system can allow the tray with the shutter to move automatically between sections of the production line, such as at a speed of 3 feet to 20 feet per minute. In embodiments, the conveying system can permit intermittent periods of non-movement for certain treatments of the shutter, such as drying.

The conveying system 40 can include a motorized belt 42 connected to the production client device, non-motorized rollers 83*a* and 83*b*, and 360 degree rollers 81*a*, 81*b*, 81*c*, and 81*d*.

A pump room 33 can be usable with the system. The pump room can have a plurality of pumps 34*a*-34*e* connected to spray treatment devices.

A tank of base coat 36 can be connected to pump 34*a* which can be connected to the first spray treatment device 76*a*. The system can include one or more tanks of base coat connected to one or more pumps. An example of a pump usable in this system can be a high pressure 450 psi to 1,000 psi made by Kremlin of Plymouth, Mich. An example of the spray treatment device is a low or high pressure spray treatment device that uses compressed air, such as a FLATLINE™ made by Mannix of Mecosta, Mich.

A tank of glaze 37 can be connected to pump 34*b* which can be connected to the second spray treatment device 76*b*.

A tank of top coat 38 can be connected to pump 34*e* which can be connected to the third spray treatment device 76*c*. The system can include one or more tanks of top coat connected to one or more pumps. An example of a pump usable in this invention can be a low pressure 15 psi to 280 psi made by Graco of Minneapolis, Minn. An example of the spray treatment device is a low or high pressure spray treatment device that uses compressed air, such as a FLATLINE™ made by Mannix of Mecosta, Mich.

In embodiments, additional spray treatment devices can be used in the system.

In embodiments, up to eight tanks of glaze, each containing a different glaze can connect to the pump or pumps that transmit the glazes in sequence to the second spray treatment device.

The system can use a first sensor 74*a* connected to the production client device to scan the tray identifier and transmit the tray identifier to the production processor providing a location at the beginning of the processing.

The system can use a second sensor 74*b* connected to the production client device to scan the tray identifier before a base coat is applied and transmit the tray identifier to the production processor to determine if the base coat is to be applied or stopped from being applied because the shutter already has a base coat applied to it.

The system can use a third sensor 74*c* connected to the production client device to scan the tray before the glaze is applied and transmit the tray identifier to the production processor and then initiate computer instructions to the second spray treatment device to apply an identified glaze onto the shutter.

In embodiments, a fourth sensor 74*d* can be connected to the production client device to scan the tray and create a first message or connect to a first alerting device 75*a*.

In embodiments, the message can indicate to the line that wipers need to actuate to wipe a portion of the glaze from the synthetic shutter. In embodiments, the message can indicate that a second glaze must be applied to the first glaze.

In embodiments, a fifth sensor 74*e* can be connected to the production client device to scan the tray and create a second message or to connect to a second alerting device 75*b*. The first and second messages, in embodiments, can provide a second set of information such as to wipe off glaze, to add glaze, or to let the synthetic shutter pass by the alerting device or that portion of the conveying system.

In embodiments a sixth sensor 74*f* can be connected to the production processor to scan the tray identifier and verify to the production processor that the tray has completed a processing circuit, in case the synthetic shutter must be turned over to process the second side of the synthetic shutter repeating a second loop of the processing line.

The message can be in the form of a color alert such as red, green or yellow. The message can be a text message to a cell phone. The message can be an email to another processor. The message can indicate one of several steps are needed, such as (i) wiping a portion of the glaze from the surface which may be a skin in embodiments, (ii) allowing the deposited glaze to dry, (iii) identifying the color of the next glaze to be applied, or (iv) do nothing to this synthetic shutter at this processing location. The message can be transmitted to another client device, such as a cell phone connected to the network, or to an alerting device connected to the network. The message can be a color coded light, a flashing light, an audible signal providing a series of beeps, or TV screens with indicators, such as red X's or green arrows.

It should be noted that if the message indicates glaze is to be removed, the glaze can be removed with an automated rotary wiper, such as model SORBINI™ made by Cefla connected to the production client device.

The first alerting device and second alerting device can be a flashing light, a cell phone, a TV screen, combinations thereof, or the like.

The thickness of the applied base coat can be from 1 wet mil to 3 wet mils.

The term "temperature control environment" as used herein can refer to air conditioning, fans, flash oven, a climate controlled room, infrared lamps, and an ultraviolet lamp. Other heating and cooling mechanisms can be used within the scope of embodiments of the system.

The temperature control equipment provides two functions: drying, which occurs first, and curing. This system is unique because it automatically applies, dries and cures coats of base coat, glaze and top coat applied to the shutter.

A first temperature control environment 78*a* can be used to create temperatures specified by the temperature requirements library that match the work order.

The system provides accelerated drying and curing faster than ambient. The use of the UV lamp at the end of the production process provides curing in 2 minutes to 6 minutes of the finished shutter instead of conventional two week curing periods.

Each temperature control environment can have temperature monitoring sensors connected to the production processor to monitor both cool temperatures and hot temperatures enabling the automated maintenance of proper temperatures during processing.

The first temperature control environment can have an infrared heater that supplies a heat of at least 120 degrees Fahrenheit onto the surface of the shutter. The temperature control environment can also include mechanical fans, which are multivariable, and air conditioning that blows cool air into the environment which can maintain the temperature in the environment from 70 degrees Fahrenheit to 100 degrees Fahrenheit. The first temperature control environment 78*a* can have a temperature sensor connected to the production processor for controlling temperature on the shutter after the base coat is applied to the shutter. Particularly usable are lamps that flash cure dry and wet coated synthetic shutters, including ultraviolet, infrared lamps and recycled heat.

A second temperature control environment 78*b*, third temperature control environment 78*c*, and fourth temperature control environment 78*d* can create temperatures specified by the temperature requirements library that match the work order for drying the first glaze, second glaze, and top coat respectively after they are applied to the shutter.

The fourth temperature control environment can be a long drying tunnel with a recycle loop 87 for recycling heated air between temperature control environments in order to reduce operating costs.

In embodiments, the system can include a fifth temperature control environment 78*e*, which can be an ultraviolet light curing oven.

Temperature controlled room 79*b* can house portions of the equipment. The temperature controlled room 79*b* can be used to reduce humidity by at least 30 percent in the air surrounding the drying shutter. The pump room can also be a temperature controlled room to ensure flowability of the glazes, base coat and top coat.

In one or more embodiments, room 79*a* does not require temperature control.

The scannable tray identifier 30, motorized belts 42, conveying system 40, sensors 74*a*-74*f*, alerting devices 75*a* and 75*b*, and temperature monitoring sensors can be in wired or wireless connection with one another, the network, the production client device, or combinations thereof.

The method can use a stain modification station 92 that uses a motorized glaze wiping method or in embodiments, people to wipe the synthetic shutter. The stain modification station 92 can provide an activity selected from the group: (i) removing portions of glaze from the synthetic shutter when the message is created, (ii) adding portions of glaze to the synthetic shutter when the message is created, (iii) using a specified tool to create a surface quality on the synthetic shutter, and (iv) combinations thereof.

A deionization chamber 100 can be used in the method. The deionization chamber that surrounds the conveying system to remove static and dust and particulate from the shutter on the conveying system.

The method can use an automated brush 101 positioned prior to the deionization chamber to remove particulate from the synthetic shutter on the conveying system.

The method involves in an embodiment, removing particulate from the shutter using a dust collection system 102 for vacuum removal of particulate and dust from the shutter positioned between the automated brush 101 and the deionization chamber 100.

In an embodiment, the method contemplates that the glaze can be dried on the shutter at ambient temperatures without heat lamps and fans operating.

The glaze can be a water based urethane glaze that is dried in a unit a time from 2 minutes to 6 minutes. The thickness of the glaze can be from 1 wet mil to 3 wet mils.

In embodiments, the second glaze can be the same as the first glaze or in a chromatically contrasting color to the first glaze. In embodiments, the second glaze can have a thickness when wet from 1 mil to 3 mils.

It should be noted that one or a plurality of pump rooms can be used connected in series or in parallel.

Embodiments of the invention can include using sprayers automatically connecting to an automated pump room which contains tanks of glaze, top coat and base coat. The pumps can be automated. The top coats can be clear, colored, or combinations thereof.

The glazes which can be water based polymer acrylic glazes or water based urethane based glazes that can each be applied using a water based spray system, with nozzles, such as CNC systems or with a reciprocating horizontal water based urethane spraying system, or combinations thereof.

The water based urethane glaze, in embodiments, can contain an antistatic agent.

The water based urethane glaze can have a 7.5 pH to 8 pH. For example, a water based urethane glaze can be provided by Gemini Coatings Company. The water based urethane glaze, the top coat, or combinations thereof can have a resin and acrylic shutter. The water based urethane glaze, the top coat, or combinations thereof can have a pigment load of about 30 weight percent to about 70 weight percent.

In embodiments, individual air conditioning units 77*a*, 77*b*, and 77*c* can be used. The individual air conditioning units can be portable and can be used to cool the electronics of the spray treatment devices, 76*a*, 76*b*, and 76*c*.

Figure 2:
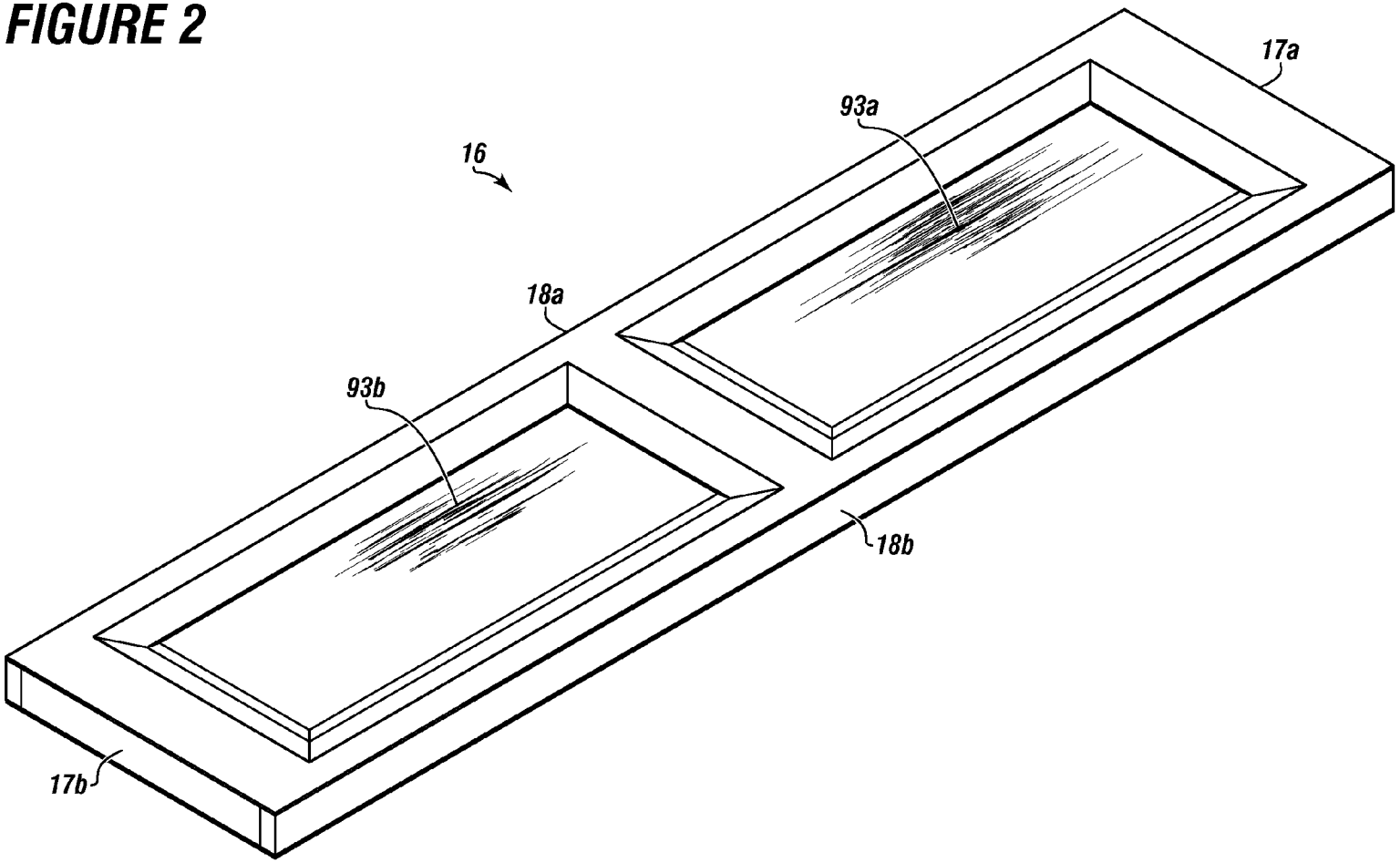
FIG. 2 depicts a shutter made by the method.

FIG. 2 depicts a shutter made by the method.

The shutter 16 can have a first horizontal edge 17*a*, a second horizontal edge 17*b*, a first vertical edge 18*a*, and a second vertical edge 18*b*. The vertical edges can be parallel to one another. The horizontal edges can be parallel to one another. The horizontal edges connect to the vertical edges.

One or more texture marks 93*a* and 93*b* can be formed into the front, back of the shutter, or combinations thereof.

Figure 3:
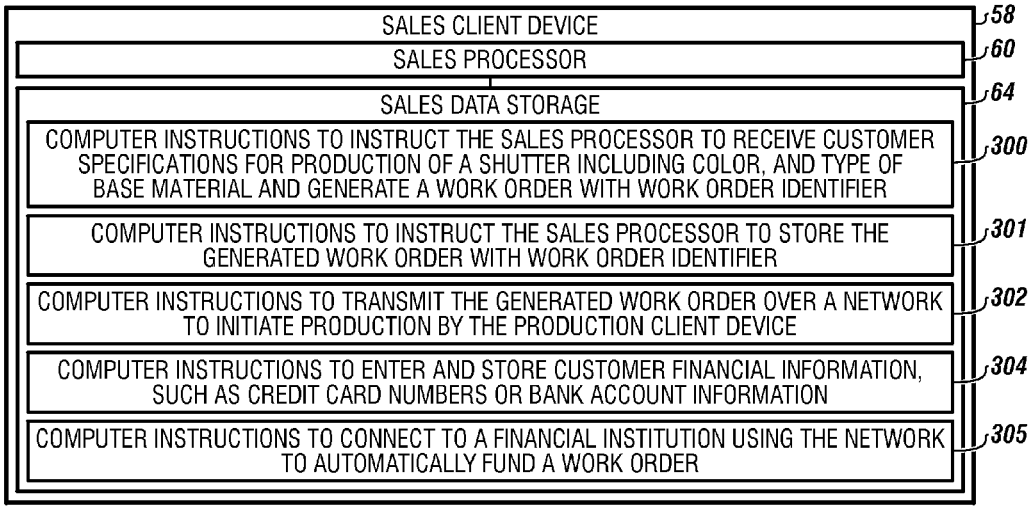
FIG. 3 depicts a diagram of the sales client device.

FIG. 3 depicts a diagram of the sales client device. The sales client device 58 can include a sales processor 60 and sales data storage 64 containing computer instructions.

The sales data storage can include computer instructions 300 to instruct the sales processor to receive customer specifications for production of a shutter including color and type of base material and generate a work order with work order identifier; computer instructions 301 to instruct the sales processor to store the generated work order with work order identifier; and computer instructions 302 to transmit the generated work order over a network to initiate production by the production client device.

The sales data storage can also include computer instructions 304 to enter and store customer financial information, such as credit card numbers or bank account information; and computer instructions 305 to connect to a financial institution using the network to automatically fund a work order.

Figure 4:
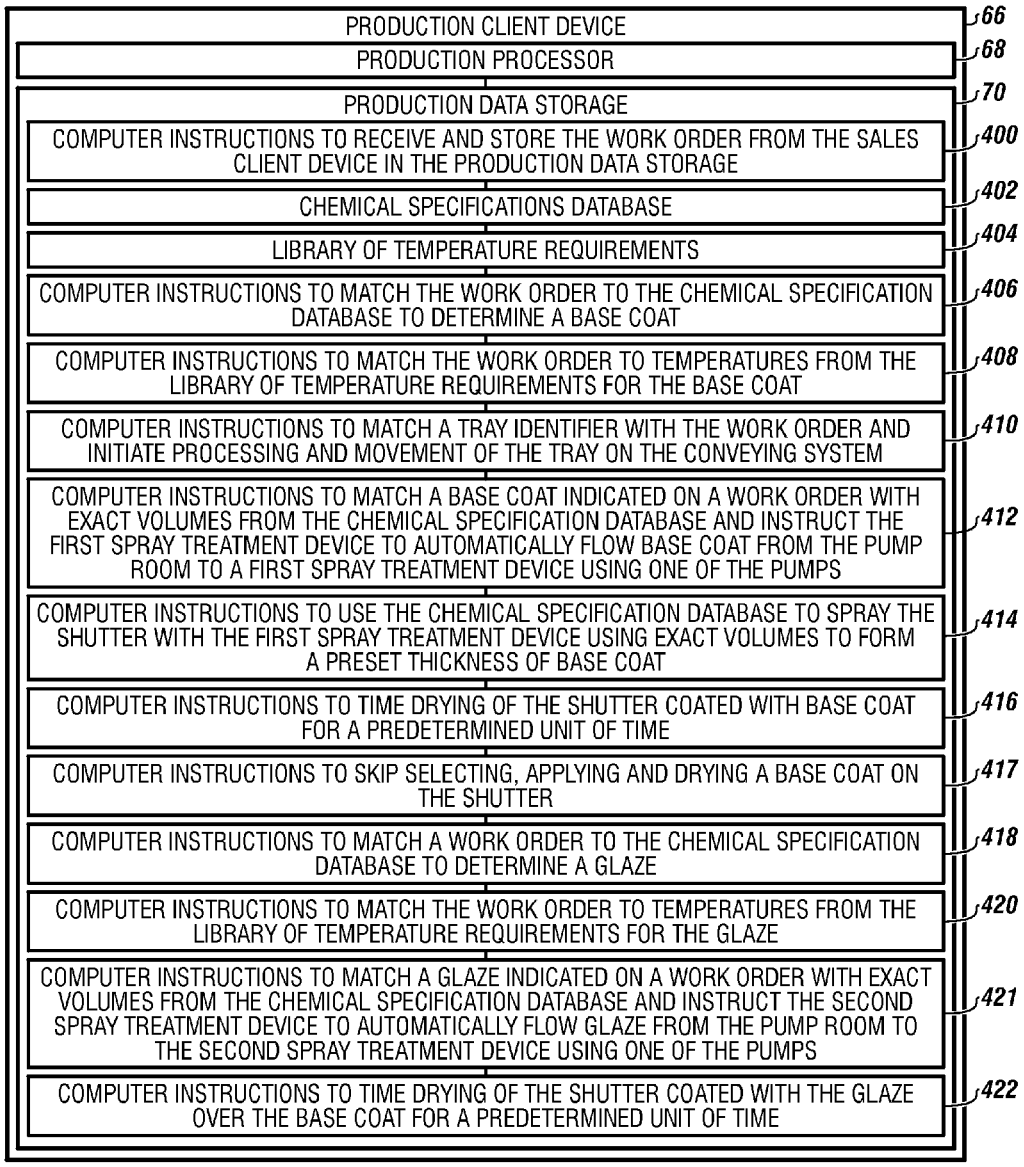
FIG. 4 depicts a diagram of the production client device.

FIG. 4 depicts a diagram of the production client device. The production client device 66 can include a production processor 68 and production data storage 70 containing computer instructions.

The production data storage can include computer instructions 400 to receive and store the work order from the sales client device in the production data storage; a chemical specifications database 402; a library of temperature requirements 404 for temperatures surrounding a shutter during processing; computer instructions 406 to match the work order to the chemical specification database to determine a base coat; computer instructions 408 to match the work order to temperatures from the library of temperature requirements for the base coat; computer instructions 410 to match a tray identifier with the work order and initiate processing and movement of the tray on the conveying system; computer instructions 412 to match a base coat indicated on a work order with exact volumes from the chemical specification database and instruct the first spray treatment device to automatically flow base coat from the pump room to a first spray treatment device using one of the pumps; computer instructions 414 to use the chemical specification database to spray the shutter with the first spray treatment device using exact volumes to form a preset thickness of base coat; computer instructions 416 to time drying of the shutter coated with base coat for a predetermined unit of time; computer instructions 417 to skip selecting, applying and drying a base coat on the shutter; and computer instructions 418 to match a work order to the chemical specification database to determine a glaze.

The production data storage can also include computer instructions 420 to match the work order to temperatures from the library of temperature requirements for the glaze; and computer instructions 421 to match a glaze indicated on a work order with exact volumes from the chemical specification database and instruct the second spray treatment device to automatically flow glaze from the pump room to the second spray treatment device using one of the pumps.

The production data storage can include computer instructions 422 to time drying of the shutter coated with the glaze over the base coat for a predetermined unit of time.

In embodiments, the spraying assembly can be isolated in a positive pressure chamber and can have one or more ventilation hoods for removing fumes therefrom. The water soluble spraying assembly can be configured to be operated remotely from the positive pressure chamber.

In embodiments, the wiping rotating members can be a Cefla SORBINI™ machine, used to remove a portion of one or more of the glazes, top coats, or combinations thereof when wet, to ensure even distribution or proper distribution on the shutter. For example, the wiping rotating members can be used to remove excess portion of glaze that does not settle in valleys of the shutter. The valleys can be grain lines, texture lines, custom marks, or other low points of cavities or ridges on the textured surface.

In embodiments, the first surface of the shutter, which can be a skin, can comprise polystyrene, fiberglass, polyurethane, or acrylonitrile butadiene styrene. The second surface of the shutter, which can be a skin, can comprise the same polymer material as the first surface or a different polymer substrate. The core can comprise a foam, wherein the foam has various characteristics such as but not limited to having a biocide treatment, having a high R value, possessing insulating qualities, possessing fire retardant qualities, being expandable and the like. In embodiments, the core can withstand impacts of up to 20 mph without deforming.

The core can be contained within a steel frame. The surfaces can be adhered to the frame and core with a spray adhesive.

In embodiments, the shutter can be a made from polypropylene/polyethylene. In embodiments, the shutter can be fiberglass, steel, a medium density fiberboard, hardboard, and combinations thereof.

Figure 5A:
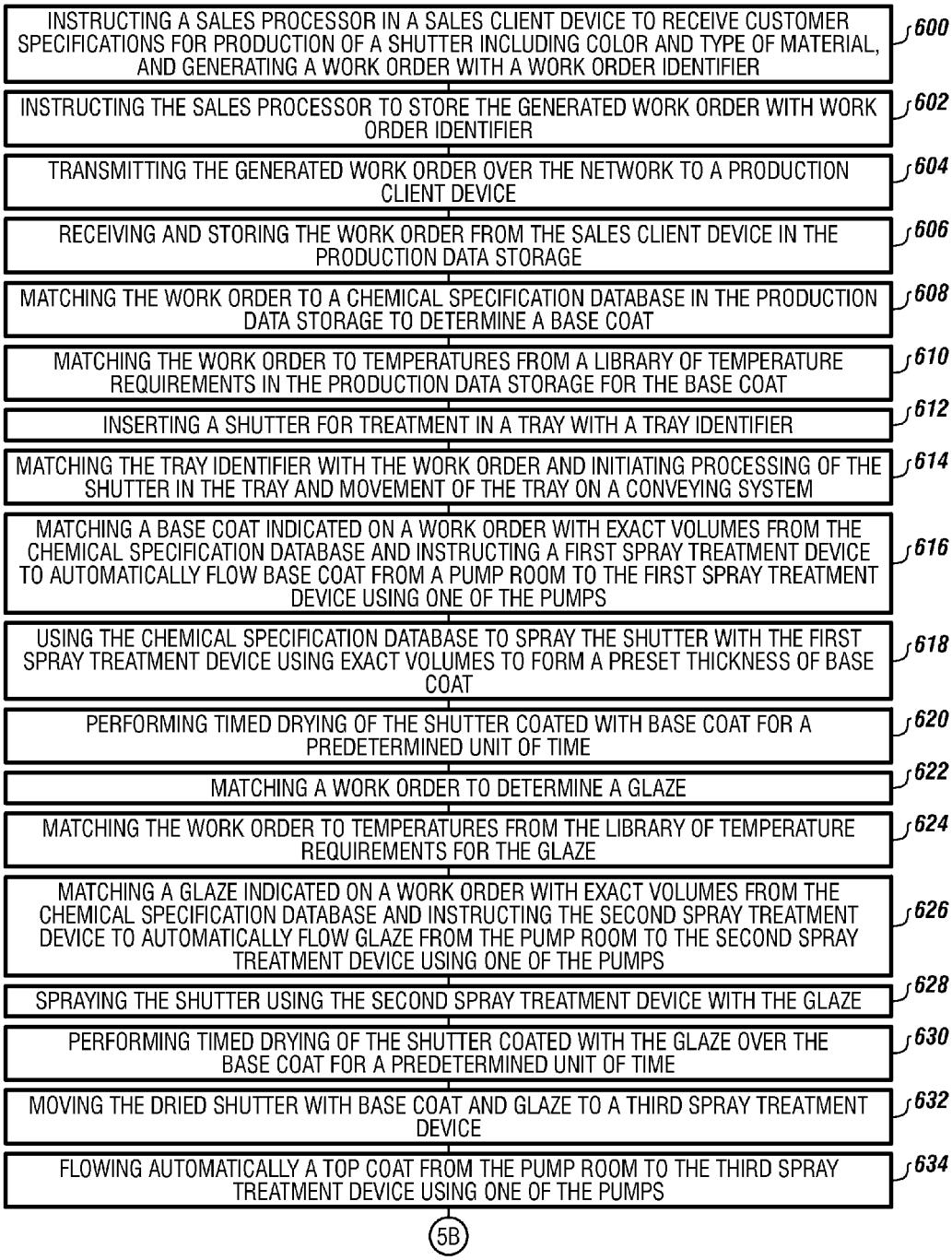
FIGS. 5A-5B depict a diagram of the steps usable in the method.
Figure 5B:
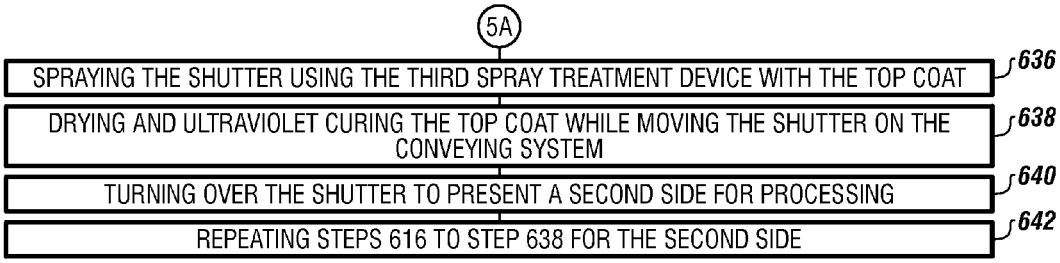

FIGS. 5A-5B depict a sequence of steps usable in the method.

The method can include instructing a sales processor in a sales client device to receive customer specifications for production of a shutter including color and type of material, and generating a work order with a work order identifier, as shown in step 600.

The method can include instructing the sales processor to store the generated work order with work order identifier, as shown in step 602.

The method can include transmitting the generated work order over the network to a production client device, as shown in step 604.

The method can include receiving and storing the work order from the sales client device in the production data storage, as shown in step 606.

The method can include matching the work order to a chemical specification database in the production data storage to determine a base coat, as shown in step 608.

The method can include matching the work order to temperatures from a library of temperature requirements in the production data storage for the base coat, as shown in step 610.

The method can include inserting a shutter for treatment in a tray with a tray identifier, as shown in step 612.

The method can include matching the tray identifier with the work order and initiating processing of the shutter in the tray and movement of the tray on a conveying system, as shown in step 614.

The method can include matching a base coat indicated on a work order with exact volumes from the chemical specification database and instructing a first spray treatment device to automatically flow base coat from a pump room to the first spray treatment device using one of the pumps, as shown in step 616.

The method can include using the chemical specification database to spray the shutter with the first spray treatment device using exact volumes to form a preset thickness of base coat, as shown in step 618.

The method can include performing timed drying of the shutter coated with base coat for a predetermined unit of time, as shown in step 620.

The method can include matching a work order to determine a glaze, as shown in step 622.

The method can include matching the work order to temperatures from the library of temperature requirements for the glaze, as shown in step 624.

The method can include matching a glaze indicated on a work order with exact volumes from the chemical specification database and instructing the second spray treatment device to automatically flow glaze from the pump room to the second spray treatment device using one of the pumps, as shown in step 626.

The method can include spraying the shutter using the second spray treatment device with the glaze, as shown in step 628.

The method can include performing timed drying of the shutter coated with the glaze over the base coat for a predetermined unit of time, as shown in step 630.

The method can include moving the dried shutter with base coat and glaze to a third spray treatment device, as shown in step 632.

The method can include flowing automatically a top coat from the pump room to the third spray treatment device using one of the pumps, as shown in step 634.

The method can include spraying the shutter using the third spray treatment device with the top coat, as shown in step 636.

The method can include drying and ultraviolet curing the top coat while moving the shutter on the conveying system, as shown in step 638.

The method can include turning over the shutter to present a second side for processing, as shown in step 640.

The method can include repeating steps 616 to step 638 for the second side, as shown in step 642.

While these embodiments have been described with emphasis on the embodiments, it should be understood that within the scope of the appended claims, the embodiments might be practiced other than as specifically described herein.

What is claimed is:

1. An automated method for creating a shutter with a wood appearance by executing computer instructions for the method resident in a non-transitory computer readable medium, the automated method comprising:

a. instructing a sales processor in a sales client device to receive customer specifications for production of a shutter including color and generating a work order with a work order identifier;

b. instructing the sales processor to store the generated work order with the work order identifier;

c. transmitting the generated work order over a network to a production client device;

d. receiving and storing the generated work order from the sales client device in a production data storage;

e. matching the generated work order to a chemical specification database in the production data storage to determine a base coat;

f. matching the generated work order to temperatures from a library of temperature requirements in the production data storage for the base coat;

g. inserting the shutter for treatment in a tray with a tray identifier;

h. matching the tray identifier with the generated work order and initiating processing of the shutter in the tray and movement of the tray on a conveying system;

i. matching a base coat indicated on the generated work order with exact volumes from the chemical specification database and instructing a first spray treatment device to automatically flow base coat from a pump room to the first spray treatment device;

j. spraying the shutter with the first spray treatment device using exact volumes from the chemical specification database to form a preset thickness of base coat;

k. performing timed drying of the shutter coated with base coat for a predetermined unit of time;

l. matching the generated work order to determine a glaze;

m. matching the generated work order to temperatures for the glaze from the library of temperature requirements;

n. matching a glaze indicated on a work order with exact volumes from the chemical specification database and instructing a second spray treatment device to automatically flow glaze from the pump room to the second spray treatment device;

o. spraying the shutter with the glaze using the second spray treatment device;

p. performing timed drying of the shutter coated with the glaze over the base coat for a predetermined amount of time;

q. moving the dried shutter with base coat and glaze to a third spray treatment device;

r. flowing automatically a top coat from the pump room to the third spray treatment device;

s. spraying the shutter with the top coat using the third spray treatment device;

t. drying and ultraviolet curing the top coat while moving the shutter on the conveying system;

u. turning over the shutter to present a second side for processing; and v. repeating steps h-t for the second side; and wherein the automated method sequentially sprays and dries the shutter with a base coat, then with a glaze over the base coat, and then a top coat while simultaneously providing a humidity controlled and temperature controlled environment to produce a cured multilayer synthetic shutter automatically.

2. The automated method of claim 1, further comprising receiving the tray with the shutter from the conveying system into a deionizing chamber and removing static and dust from the shutter prior to spraying with the base coat.

3. The automated method of claim 2, further comprising removing with an automated brush, prior to the deionization chamber, particulate from the shutter on the conveying system.

4. The automated method of claim 3, further comprising vacuum removal with a dust collection system of particulate and dust from the shutter positioned between the automated brush and the deionization chamber.

5. The automated method of claim 1, further comprising performing an operation selected from the group consisting of: (i) removing portions of glaze from the shutter when a message is created, (ii) adding portions of glaze to the component when the message is created, (iii) using a tool to impart a surface quality on the shutter, and (iv) combinations thereof, at a stain modification station.

6. The automated method of claim 5, wherein the stain modification station further comprises automated wipers connected to the production client device.

7. The automated method of claim 1, wherein the sales client device and/or the production client device is: a laptop, a cell phone, a desktop computer, a tablet, or combinations thereof.

8. The automated method of claim 1, wherein the conveying system comprises a heat recycle loop allowing heat from one temperature control environment to supplement heat of another connected temperature control environment.

9. The automated method of claim 1, further comprising non-motorized rollers and 360 degree rollers positioned between motorized belts to facilitate moving of the tray between spray treatment devices, between temperature control environments, or combinations thereof.

10. The automated method of claim 1, wherein the conveying system comprises at least one alerting device connected to the production client device, wherein the alerting device is a flashing colored light, a cell phone, or combinations thereof.

11. The automated method of claim 1, wherein computer instructions in the sales client device instruct the sales client device to enter and store customer financial information, and to connect to a financial institution using a network to fund a work order automatically.

12. The automated method of claim 1, further comprising applying with a fourth spray treatment device between the second spray treatment device and the third spray treatment device, a second glaze over the first glaze prior to applying the top coat.

13. The automated method of claim 1, wherein computer instructions in the production data storage to instruct one of the sensors connected to the production client device to scan the tray identifier after the base coat is dry, create a message, and transmit the message to an alerting device to remove all or a portion of the glaze.

14. The automated method claim 1, wherein the scanner connected to the production client device is a member of the group consisting of: a bar code scanner, an RFID scanner, a QR code scanner, or combinations thereof.

15. The automated method of claim 1, wherein the shutter is a member selected from the group consisting of: a polypropylene/polyethylene shutter, a fiberglass shutter, a steel shutter, a medium density fiberboard shutter, a hardboard shutter, and combinations thereof.

* * * * *